United States Patent [19]

Marcus

[11] Patent Number: 4,794,038

[45] Date of Patent: Dec. 27, 1988

[54] POLYESTER FIBERFILL

[75] Inventor: Ilan Marcus, Versoix, Switzerland

[73] Assignee: E. I. Du Pont de Nemours and Company, Wilmington, Del.

[21] Appl. No.: 921,644

[22] Filed: Oct. 21, 1986

Related U.S. Application Data

[63] Continuation-in-part of Ser. No. 734,423, May 15, 1985, Pat. No. 4,618,531.

[51] Int. Cl.[4] ..... D04H 1/58

[52] U.S. Cl. ..... 428/288; 5/448; 28/159; 28/162; 264/15; 264/117; 264/121; 264/503; 264/517; 428/290; 428/297; 428/373

[58] Field of Search ..... 428/288, 296, 369, 370, 428/373, 375, 395, 85, 290, 297; 264/15, 117, 121, 503, 517; 28/159, 162; 5/448

[56] References Cited

U.S. PATENT DOCUMENTS

| | | | |
|---|---|---|---|
| 3,050,821 | 1/1960 | Wilian | 28/82 |
| 3,118,012 | 3/1962 | Wilian | 264/176 |
| 3,416,952 | 12/1968 | McIntyre et al. | 117/118 |
| 3,671,379 | 3/1971 | Evans et al. | 161/173 |
| 3,702,260 | 11/1972 | Jayne et al. | 117/100 |
| 3,892,909 | 7/1975 | Miller | 156/61 |
| 3,937,777 | 2/1976 | Wenard et al. | 428/288 |
| 4,065,599 | 12/1977 | Nishuimi et al. | 428/402 |
| 4,144,294 | 3/1979 | Werthaiser et al. | 264/15 |
| 4,172,174 | 10/1979 | Takage | 428/288 |
| 4,199,642 | 4/1980 | Copper et al. | 428/288 |
| 4,281,042 | 7/1981 | Pamm | 428/288 |
| 4,304,817 | 12/1981 | Frankosky | 428/288 |
| 4,413,030 | 11/1983 | Tesch et al. | 428/299 |
| 4,418,116 | 11/1983 | Scott | 428/288 |
| 4,481,247 | 11/1984 | Tesch et al. | 428/234 |
| 4,520,066 | 5/1985 | Athey | 428/288 |

FOREIGN PATENT DOCUMENTS

| | | |
|---|---|---|
| 0013427 | 12/1979 | European Pat. Off. . |
| 56-68108 | 6/1981 | Japan . |
| 125377 | 6/1986 | Japan . |
| 2065728 | 7/1981 | United Kingdom . |

*Primary Examiner*—James J. Bell

[57] ABSTRACT

Polyester fiberfill having spiral crimp that is randomly-arranged and entangled in the form of fiberballs with binder fibers, preferably with a minimum of hairs extending from the surface of the fiberballs, so as to be air-transportable on account of the low cohesion between the balls. A process for making such fiberballs by repeatedly air-tumbling small tufts of such fiberfill/binder/blend against the wall of a vessel. Improved bonded batts or molded articles or other bonded articles obtained by bonding such fiberballs.

26 Claims, 3 Drawing Sheets

POLYESTER FIBERFILL

CROSS REFERENCE TO RELATED APPLICATION

This application is a continuation-in-part of application Ser. No. 734,423, filed May 15, 1985, to be issued as U.S. Pat. No. 4,618,531, Oct. 21, 1986.

TECHNICAL FIELD

This invention concerns improvements in an relating to polyester fiberfilling material, commonly referred to as polyester fiberfill, and more particularly to providing polyester fiberfill in the form of fiberballs containing binder fibers, that may be bonded to provide useful new through-bonded products, and to processes for preparing these new products.

BACKGROUND OF INVENTION

Thermally-bonded (polyester) fiberfill batts (or battings) are well known and have gained large scale commercial use, particularly in Europe. Binder fibers can be blended intimately into the fiberfill to achieve true "through-bonding" of fiberfill batts, and thus achieve better durability versus resin-bonding, which was the conventional method, and can also provide reduced flammability versus resin-bonding. Such binder fiber blends are used on a large scale in furnishings, mattresses and similar end-uses where strong support is desired. However, they are seldom used as the only filling material in these end-uses, particularly in furnishing seat cushions, where the common practice is to use the fiberfill batts as a "rapping" for a foam core. It is believed that the main reason is probably that, to obtain the desired resilience and performance in 100% fiberfill cushions, it would be necessary to provide such relatively high density as has hitherto been considered too costly and difficult with the present techniques, and as might not provide desirable performance aesthetically. In a conventional fiberfill batt, the fibers are arranged in parallel layers which are bonded together. In such a layered structure, any pressure applied during use as a cushion is essentially perpendicular to the direction of the fibers and I believe that may be at least partly why such a high density must be reached to achieve the desired resilience and durability using conventional layering and bonding techniques.

SUMMARY OF INVENTION

According to the invention, there are provided new fiberfill structures that may be bonded to provide products of improved performance, especially with regard to resilience and durability, over what has been available commercially hitherto, as will be explained hereinafter.

According to one aspect of the invention, there are provided fiberballs of average dimension about 2 to about 15 mm, consisting essentially of randomly-arranged, entangled, spirally-crimped polyester fiberfill having a cut length of about 10 to about 100 mm, intimately blended with binder fibers in amount about 5 to about 50% by weight of the blend. Alternatively, there are provided fiberballs of average dimension about 2 to 15 mm, consisting essentially of randomly-arranged, entangled, spirally-crimped bicomponent polyester/-binder material fibers, having a cut length of about 10 to about 100 mm.

According to another aspect of the invention, there is provided a process for making polyester fiberballs from an intimate blend of spirally-crimped polyester fiberfill and of binder fibers, wherein small tufts of the blend are repeatedly tumbled by air against the wall of a vessel to provide the fiberballs. Alternatively, there is provided a process for making polyester fiberballs from spirally-crimped bicomponent polyester/binder material fibers, wherein small tufts of the spirally-crimped fibers are repeatedly tumbled by air against the wall of a vessel to provide the fiberballs.

According to further aspects of the invention, there are provided entirely new resilient shaped articles or structures consisting essentially of thermally-bonded, spirally-crimped polyester fiberfill, and processes for making these bonded products from the fiberballs of the invention.

DETAILED DESCRIPTION OF THE INVENTION

Figure 1:
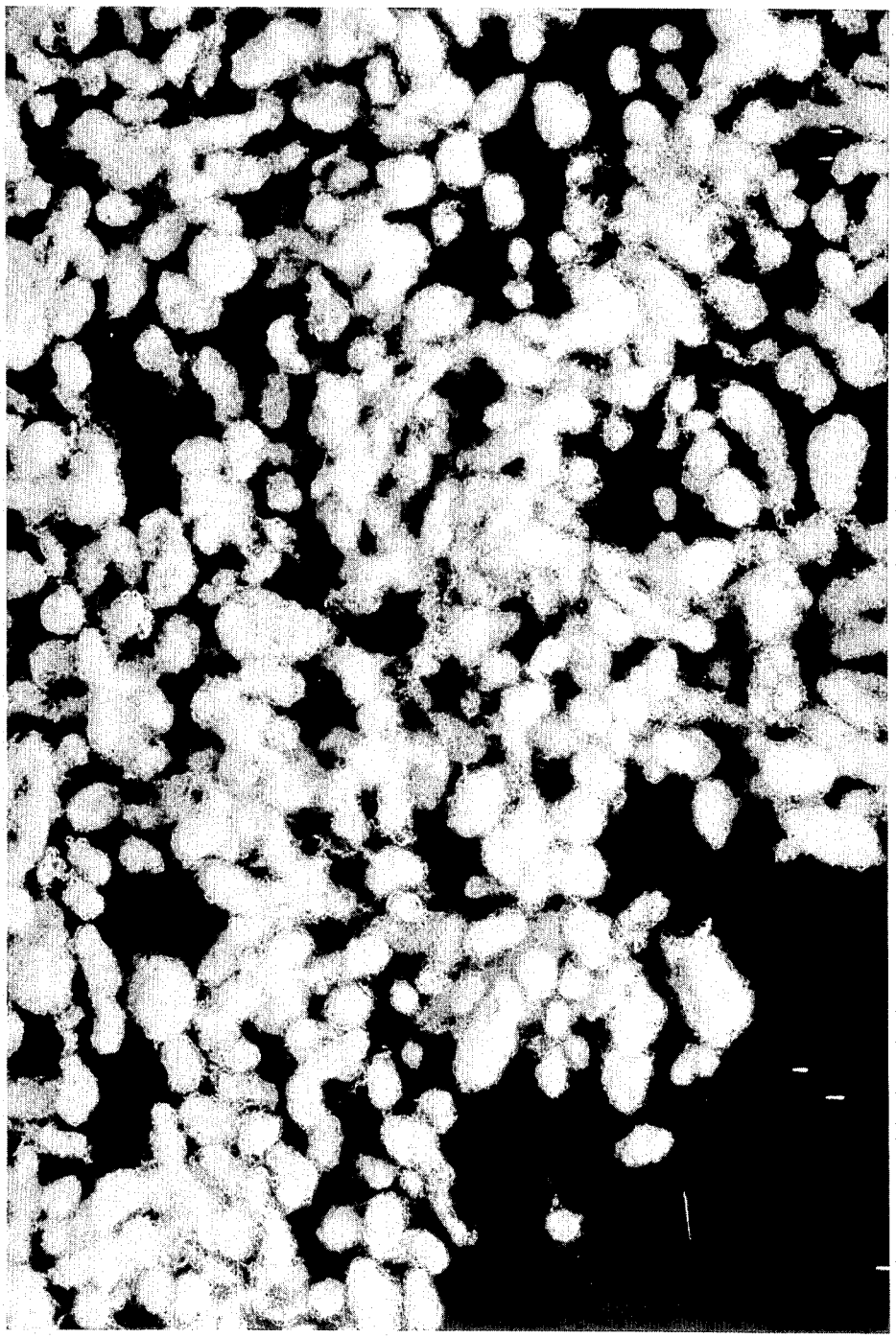
FIGS. 1 and 2 are enlarged photographs of fiberballs according to U.S. Pat. No. 4,618,531.
Figure 2:
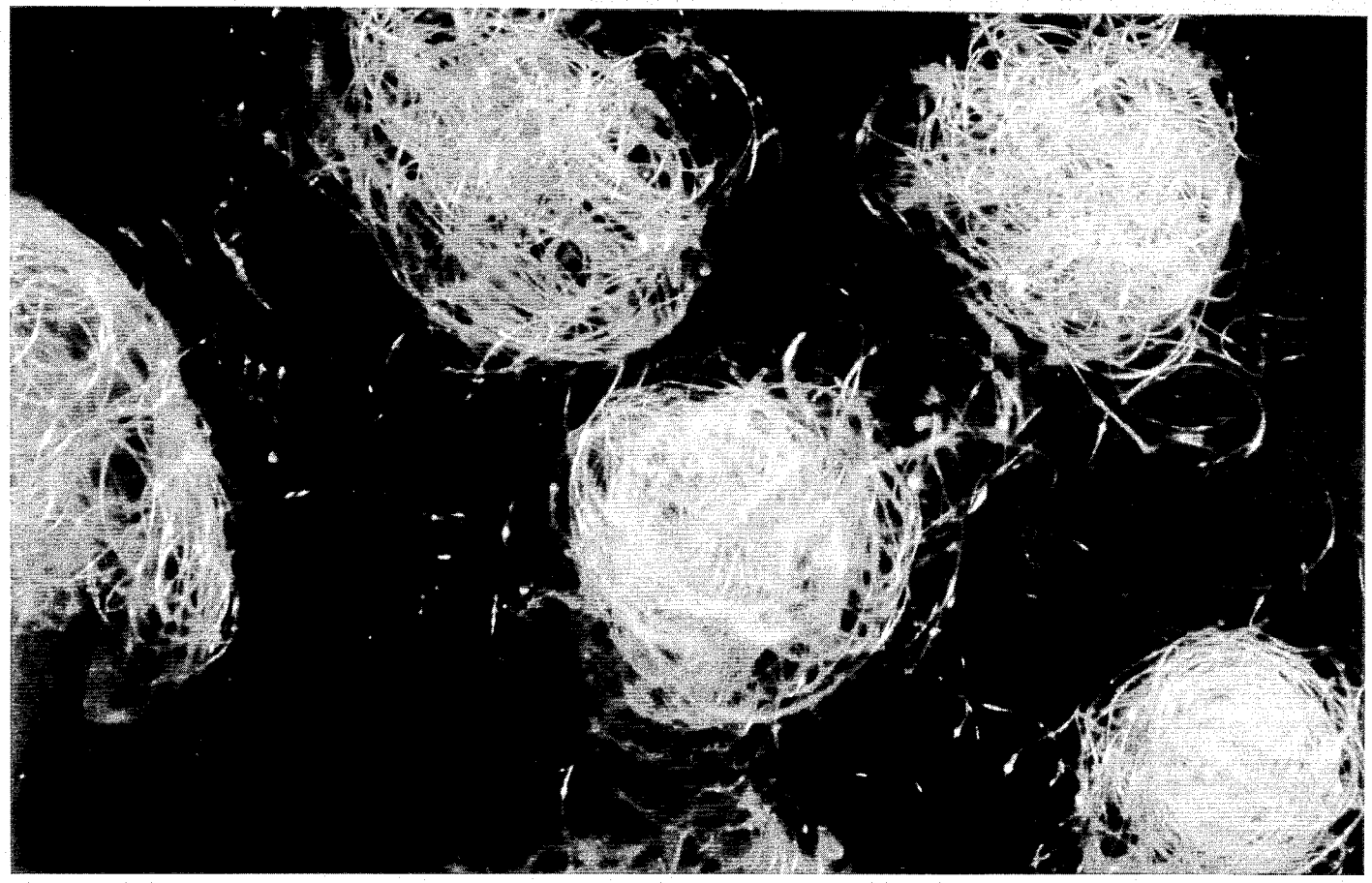

Some idea of the nature of the fiberballs of the invention, and especially of the nature of the configurations taken up by the spirally-crimped fiberfill therein, can be gained from FIGS. 1 and 2 of the accompanying drawings. For convenience, at this point, reference is made to my copending application, i.e. U.S. Pat. No. 4,618,531, directed to refluffable fiberballs of spirally-crimped polyester fiberfill, and to a process for making such fiberballs, the disclosure being incorporated herein by reference. The objective of my copending application was to provide a synthetic product as a real alternative to down, in the sense of having refluffable characteristics (available from down) and also with washability (unlike down) and at a lower cost than down. As indicated, this objective was obtained by providing refluffable fiberballs from spirally-crimped polyester fiberfill. An essential element was the use of such spirally-crimped fiberfill. Such refluffable fiberballs can be obtained by air-tumbling small tufts of fiberfill (having spiral crimp) repeatedly against the wall of a vessel as illustrated in FIGS. 5 and 6 of my copending application, corresponding to FIGS. 3 and 4 herein. The objective of the present invention is entirely different from the objective of my copending application, as indicated above. Moreover, the fiberballs of the present invention are distinguished from the refluffable fiberballs specifically disclosed in my copending application, by the content of binder fibers, to achieve the bonding and the new bonded products that are the objective of the present invention. Nevertheless, the techniques used for making fiberballs are similar, and essentially the same apparatus may be used in both instances, and FIGS. 1 and 2 may be helpful in visualizing the fiberballs of the invention, and the spirally-crimped fiberfill therein.

As indicated, an essential element of the present invention is the use of fibers having significant curliness, such as is referred to herein as spirally-crimped fiberfill. Such fibers have a "memory" that provides them with a natural tendency to curl, i.e. to take up helical or spiral configurations. The provision of such spiral crimp is itself well-known for other purposes. This can be provided economically by asymmetric-jet-quenching of freshly-extruded polyester filaments, as taught, e.g. in Kilian U.S. Pat. Nos. 3,050,821 or 3,118,012, especially for filaments of drawn denier in the range about 1 to 10. The spiral crimp is believed to result from differences in crystalline structure across the cross-section of the fibers, which provide differential shrinkage, so the fibers curl helically upon appropriate heat-treatment. Such curls need not be regular, and in fact are often quite irregular, but are generally in 3 dimensions and so are referred to as spiral crimp to distinguish from the essentially 2-dimensional saw-tooth crimp induced by mechanical means, such as a stuffer box, which is the preferred method used commercially for crimping polyester tow precursors to staple fiber at this time. Asymmetric-jet quenching is the technique that was used to make the fiberballs in Examples 1–5 herein. An alternative way to provide spiral-crimp is to make bicomponent filaments, sometimes referred to as conjugate filaments, whereby the components have different shrinkages upon being heat-treated, and so become spirally-crimped. Bicomponents are generally more expensive, but may be preferred for some end-uses, especially if it is desired to use fiberfill of relatively high denier, such as is more difficult to spiral-crimp adequately by an asymmetric-jet-quenching technique. Bicomponent polyester filaments are taught, e.g., in Evans et al. U.S. Pat. No. 3,671,379. Particularly good results have been achieved by using a bicomponent polyester fiberfill sold by Unitika Ltd. as H38X, referred to in Example IIIB of my copending application (DP-3270-B) filed simultaneously herewith. Of course, especially with bicomponent filaments, there is no need to use only polyester components. A suitable polyamide/polyester bicomponent filament can be selected to give a good spiral-crimp. Still further methods of obtaining fiberfill with a "memory" and ability to crimp spirally are disclosed in Nippon Ester Japanese Patent Application Kokai No. 57-56512, published Apr. 5, 1982, and in Toyo Boseki U.K. Pat. No. 1,137,028, which indicate that hollow fiberfill can be obtained with this property.

Apart from the spiral-crimp, which is essential, the fiberfill staple fibers may be solid or hollow, of round cross-section or non-round, and otherwise as disclosed in the prior art, according to the aesthetics desired and according to what materials are available.

The spiral-crimp must be developed in the fiberfill so that making the fiberballs becomes possible. Thus a tow of asymmetrically-jet-quenched polyester filaments is prepared by melt spinning and gathering the spun filaments together. The tow is then drawn, optionally coated with a surface modifier, optionally relaxed before cutting conventionally to form staple fibers, and preferably relaxed after cutting to enhance the asymmetric character of the fibers. This character is required so the fibers will curl and form the desired fiberballs with minimal hairiness. Conventional mechanical crimping, such as by a stuffer-box technique, is not generally desired because inappropriate heat-treatment can destroy the desired spiral-crimp, and so such mechanically-crimp fiberfill would not form fiberballs, as desired. Such mechanical crimping is not an alternative to spiral-crimp, because mechanical crimping gives a saw-tooth crimp which will not form the desired fiberballs. However, we have found that fiberballs can be obtained if some suitable degree of mechanical crimp with appropriate heat treatment is provided to the precursor filamentary tow, in which case the eventual fiberfill will have a configuration that is a result of combining this mechanical crimp and spiral crimp. This is the technique used in Examples 6–10 herein. We refer to this crimp as Ω-crimp (omega-crimp) because the configuration of the fibers resembles the shape of this Greek letter Ω, being a combination of a saw-tooth from the mechanical crimping superimposed on the curl of the spiral crimp obtained because of the "memory" referred to above. This Ω-crimp may be obtained in other ways.

An essential element of the fiberballs of the present invention is the binder fibers, which are preferably used in amount about 5 to about 50% by weight of the blend, the precise amount depending on the specific constituents and the desired end-use, but about 10 to about 30% generally being preferred. As indicated above, binder fibers are well known and have been used commercially for obtaining thermally-bonded batts of polyester fiberfill. Such conventional binder fibers, e.g. of lower melting polyester, may be used according to the present invention as such, or modified appropriately. Several options are, however, available, as will be clear hereinafter. The general requirements for binder fibers are conveniently set out in Pamm U.S. Pat. No. 4,281,042 and Frankosky U.S. Pat. No. 4,304,817, the disclosures of which are hereby incorporated by reference. As indicated therein, and discussed hereinafter, depending on the intended end use, it may be preferred to provide blends of binder fiber with surface-modified (slickened) fiberfill (to provide aesthetics that may be desired in the thermally-bonded product), including triple blends also with unslickened fiberfill (if desired to provide bonding sites, when the slickened fiberfill is not so amenable for this purpose) as well as the binder fibers themselves. An important requirement of the binder material is that it have a bonding temperature lower than the softening temperature of the polyester fiberfill. Thus the binder should be of appropriately lower melting point than the polyester fiber, e.g. some 20° C. or 30° C., or preferably 50° C. lower, depending on the sensitivity of the materials to heat and the efficiency of the bonding equipment and conditions, so that thermal bonding of the blend may take place conveniently without deleteriously affecting the physical properties of the polyester fiberfill itself, or be otherwise capable of being sensitized so as to provide its essential function of bonding the polyester fiberfill. It will be understood that, if the binder fibers are monocomponent fibers in the blend, they may lose their fiber form during the bonding operation, and thereafter the binder may exist merely as globs binding the intersections of the polyester fiberfill. If, however, the binder fibers are bicomponent fibers, e.g. if preferred sheath-core fibers are used, and only the sheath comprising e.g. about 5 to about 50% of the bicomponent is a binder material, whereas the core is a higher melting component that can remain in fiber form after the bonding operation, then the final bonded product will comprise these remaining core elements from the original binder fibers in addition to the polyester fiberfill. Indeed, it may be possible and desirable to provide a multicomponent binder fiber that is also spirally crimped and so can by itself perform all the requirements of the present invention. In other words, there would be no need for a blend of separate binder fibers and spirally-crimped fibers, but the fiberballs of the invention would consist essentially of spirally-crimped, multicomponent, binder fibers that are first formed into the fiberballs, and then at a later stage treated so to activate the binder material component, thereby leaving a bonded assembly or shaped article of bonded fiberfill.

The binder fibers are preferably of similar dimensions and processing characteristics to the polyester fiberfill, to permit easy intimate blending, although this is not essential, and may not even be desirable depending on the intended final use and the components. For instance, if the binder fiber is a bicomponent, used in relatively large quantities, it may be desirable that the final bonded product comprise bonded fibers of essentially similar dimensions and characteristics. As indicated, it may be advantageous to provide the binder fiber in spirally-crimped form. This will be particularly desirable if the binder fiber comprises a significant or large proportion of any blend, so as to facilitate the formation of the fiberballs.

Bearing the above in mind, the selection of the various characteristics, amounts and dimensions of the fiber const ituents will depend generally on the intended end use, and the aesthetics of the bonded article, and such considerations as cost and availability. Generally, the dtex will be beteween 1 and 30, preferably at least 3 dtex, and preferably less than 20 dtex, and often approximately 5 dtex or up to 10 dtex, and the cut length is generally about 10 to about 100 mm, preferably at least 20 mm preferably up to 60 mm.

As indicated, it may be desirable to slicken (lubricate the surface) at least some of the fibers, and to use a conventional slickening agent for this purpose. This may be desirable for several reasons, e.g. for aesthetics in the final bonded product, and to improve durability, and also to reduce the cohesion of the fiberballs, and to permit them to be transported, e.g. by blowing. If a conventional silicone slickener is used, however, this will reduce the ability of the fiberfill to bond, and increase the flammability, as disclosed already and in my copending application, DP-4155, filed simultaneously herewith, and so, preferably, the fiberfill will be coated with a hydrophilic slickener consisting essentially of chains of poly(alkylene oxide) as disclosed therein.

Several such materials are disclosed in the literature. Preferred materials are "curable" to the polyester fiberfill. For instance, a segmented copolymer of poly(ethylene terephthalate) and poly(ethylene oxide). Some such materials are available commercially, such as the textile finishing agent sold under the trademark "ATLAS" G-7264 by ICI Specialty Chemicals, Brussels, but it may be preferred to use materials with less fiber to metal friction, as well as a low fiber to fiber friction. Another material is sold as "ZELCON" 4780, by E. I. du Pont de Nemours and Company. Other materials are disclosed in Raynolds U.S. Pat. No. 3,981,807. Several segmented copolyesters consisting essentially of poly(ethylene terephthalate) segments and of poly(alkylene oxide) segments, derived from a poly(oxyalkylene) having a molecular weight of 300 to 6,000 and dispersions thereof are disclosed in McIntyre et al. U.S. Pat. Nos. 3,416,952, 3,557,039 and 3,619,269, and in various other patent specifications disclosing like segmented copolymers containing poly(ethylene terephthalate) segments and poly(alkylene oxide) segments. Generally the poly(alkylene oxide) will be a poly(ethylene oxide), which is a matter of commercial convenience. Other suitable materials include modified poly(ethylene oxide)/poly(propylene oxide) grafted with functional groups to permit crosslinking, e.g. by treatment with citric acid, such as are available commercially from Union Carbide as "UCON" 3207A. Other materials that may include particularly useful compositions are disclosed in Teijin EP 159 882 and in ICI Americas EP 66944. Choice of a particular slickener will depend on the desired end-use, and many of the indicated slickeners differ in their ability to lubricate, e.g. to lower fiber-to-fiber and/or fiber-to-metal frictions and amounts of anion groups. If, for example, moisture transport and durability are desired, but softness is not so important, item 12 in EP 66944 may be desirable. Depending on the aesthetics desired, the amount of slickener may be adjusted, between about 0.05 and about 1%, preferably about 0.15 to about 0.5%, on the weight of the fiberfill, being generally desirable, depending on, e.g., the type of slickener and the effect desired.

Polyester fiberfill, like other staple fiber, has been generally transported in compressed bales, which are conventionally first treated in an opener, so as to separate the individual fibers to some extent before they are further processed, e.g. on a card if a parallelized web is desired. For making products of the invention, it is not necessary, and is generally undesirable, to completely parallelize the fibers, but it is desirable first to open and separate the fibers into discrete tufts before treatment to form the fiberballs, as will be described.

The fiberballs are formed by air-tumbling small tufts of fiberfill (having spiral crimp) repeatedly against the wall of a vessel so as to densify the bodies and make them rounder. The longer the treatment, generally the denser the resulting balls. It is believed that the repeated impacts of the bodies cause the individual fibers to entangle more and lock together because of the curl of the spiral crimp. In order to provide an easily-transportable product, however, it is also preferred to reduce the hairiness of the balls, because the spiral-crimp of any protruding fibers will raise the cohesion between neighboring fiberballs. This cohesion can also be reduced somewhat, however, by thorough distribution of a slickener, as described herein, to increase lubricity between the fiberballs. The slickener also affects the aesthetics. Depending on the aesthetics desired, the amount of tumbling and application of slickener may be adjusted.

Figure 3:
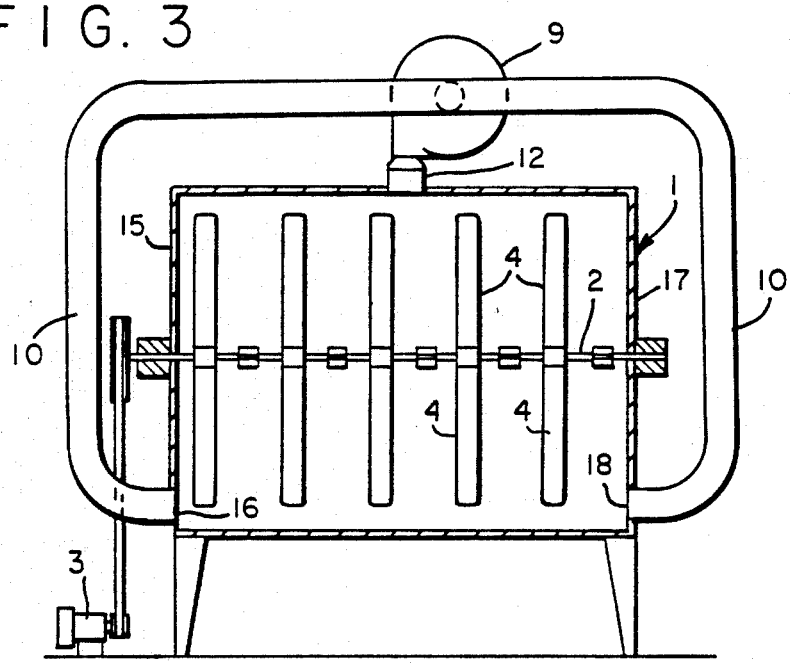
FIGS. 3 and 4 are schematic drawings in section of the machine used to make the fiberballs in the Examples herein.
Figure 4:
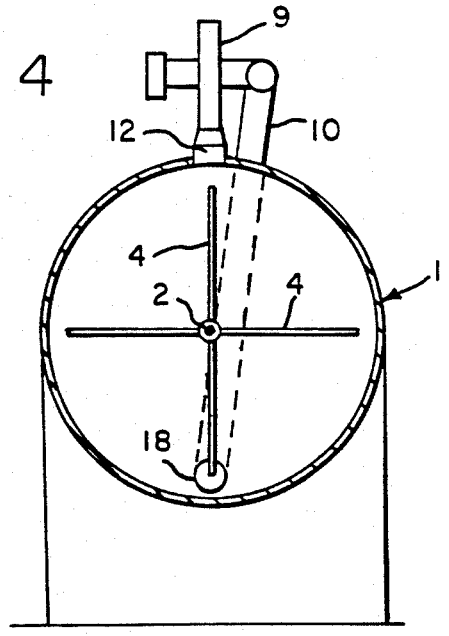

The air-tumbling has been satisfactorily performed in a modified machine, based on a Lorch machine as described in my copending application, now U.S. Pat. No. 4,618,531, and as illustrated in FIGS. 3 and 4 herein. This machine was used in the Example herein.

The resulting fiberballs are easily transported, for instance, by blowing, especially if the hairiness is reduced by increasing lubricity, as described herein and in my copending application. These fiberballs may then be compressed and bonded together to form bonded structures that may superficially resemble bonded batts or molded into any desirable shape. For instance, the fiberballs may be blown into a light ticking, or a non-woven, and then heated to produce a cushion-like article in the shape of the ticking. As a result, the final product has improved resilience and performance, as indicated hereinafter, and is very different from prior art bonded batts. It is believed that the improvement results from the fact that the fibers have a significant component in every direction, as contrasted with the primarily parallelized fibers of prior art layered batts. Another advantage is the faster moisture transport, which is believed to result from porosity between the fiberballs, which is of particular potential interest for structures such as cushions and matresses wherein the principal of only stuffing material is such fiberballs. The moisture transport characteristics can be further enhanced by the use of a permanent hydrophilic finish, as indicated. Thus, the major expected end uses for the final structures are for furnishing cushions, car seats, matresses and like products. Such structures may, if desired, be molded initially into the form finally desired by heating to activate the binder fiber in the fiberballs within a ticking within a mold of the desired shape. Or the bonded structure may be formed in long lengths like prior art bonded batts, or in other standard shapes, and then be cut and, if necessary, be reshaped as desired. Greater flexibility in this regard is available than with prior art bonded batts.

Moreover, it may prove feasible to use the fiberballs of the invention in a manner completely different from that commercially used heretofore with prior fiberfill products, namely by bonding the fiberballs individually in a fluidized bed, and then blowing the individual balls into a ticking. The resulting new product would be refluffable, and so entirely different from prior art bonded fiberfill products, but more like cushions filled with feathers and chopped foam. Such new product would have, in addition to good resilience and durability, the novel characteristic that the individual balls could move in the ticking in a similar manner to down and feather blends. In such products, it would again be desirable to reduce cohesion by application of appropriate lubricants or slickeners for this purpose (and for promoting moisture transport, as disclosed in my copending application). This reduction of hairiness/cohesion will improve the transportability of the fiberballs, e.g. by blowing, and improve the softness of the product in end uses where this would be desirable, and would also offer an improved degree of moisture transport that is believed unattainable with prior products. In such products, the dimensions of the fiberballs will likely be important for aesthetic reasons, as described in my copending application, U.S. Pat. No. 4,618,531, average dimensions of about 2 to about 15 mm being preferred.

DESCRIPTION OF TEST METHODS

Bulk measurements were made conventionally on an Instron machine to measure the compression forces and the height of each sample cushion, which was compressed with the appropriate foot of diameter 10 cm attached to the Instron. From the Instron plot are noted (in cm) the Second Initial Height (IH2) of the test material, i.e. the height at the beginning of the second compression cycle. The Support Bulk (SB 7.5N), i.e. the height under a compression of 7.5N, and the Bulk (height) under a compression of 60N, (B 60N). The softness is calculated both in absolute terms (AS, i.e. IH2-SB 7.5N) and in relative terms (RS—as a percentage of IH2). The firmness of a cushion correlates with strong support, i.e. the Support Bulk, and inversely with softness.

Resilience is measured as Work Recovery (WR), i.e. the ratio of the area under the whole recovery curve calculated as a percentage of that under the whole compression curve. The higher the WR, the better the resilience.

Durability—Each sample cushion was covered with a fabric having an air permeability of about 100 1/sq.m./sec and its compression curve was measured and recorded as BF (before flexing). The cushion was then submitted to 10,000 successive flexings under a pressure of 13 kPa (about 133 g/sq.cm.) at a rate of 1400 cycles/hour and the compression curve measured again and recorded as AF (after flexing) so as to show any changes in bulk and resilience resulting from the flex test, as percentages (Δ).

The invention is further described in the following Examples. All parts and percentages herein are by weight, and with respect to the total weight of fiber, unless otherwise stated.

Example 1

A tow of asymmetrically-jet-quenched drawn poly(ethylene terephthalate) filaments of 4.7 dtex was prepared conventionally without mechanical crimping, using a draw ratio of 2.8X. The tow was cut to 36 mm cut length and relaxed at a temperature of 175° C. to develop the spiral crimp. The staple was blended in the ratio of 80/20 with a sheath/core binder fiber, cut to the same cut length, and having a 4.4 dtex. The blend was opened on a commercial opener and the resulting opended blend was processed for 6 seconds on a Trutzschler cotton beater to separate the fibers into discrete small tufts. A batch of the resulting product was blown into the modified Lorch machine, as described and illustrated, and processed for 1 minute at 250 rpm, then for 3 minutes at 400 rpm to convert the tufts into consolidated fiberballs.

The fiberballs were packed to different extents, to provide a series of different densities from 20 $Kg/m^3$ (A) to 50 $Kg/m^3$ (E), as indicated hereinafter, into a box (mold) made of wire mesh reinforced with 2 mm thick stainless steel bars with a rectangular base of 40×33 cm and where the height can be varied between 1 and 25 cm. Each sample of fiberballs was compressed to a similar height of about 9 cm, while varying the resulting density by changing the quantity of fiber balls packed into the box. The mold was then placed in an oven with an air flow across the rectangular base at a temperature of 160° C. for 15 minutes. After cooling the mold, the resulting "cushion" was released and the compression characteristics were determined, and are recorded in the top part of Table 1 as Items A–E. This indicates that the support obtainable from products of the invention can be varied over a wide range, by varying the density, and that excellent resilience (WR) is also obtained, especially at higher densities. The durability is also excellent; (this is measured and discussed hereinafter in relation to higher density (firmer) products, with reference to Table 2). For comparison, similar compression measurements were made and are recorded in the lower part of Table 1 for 5 conventional materials bonded under exactly the same procedure as in Example 1. The compositions of these "Comparisons" was a follows:

1. A triple 60/20/20 blend, compressed to about 20 $Kg/m^3$ (for comparison with Item A of the invention), using the same binder fiber (of dtex 4.4) in the same amount 20%, but containing 80% of commercial poly(ethylene terephthalate) fiberfill of three times higher denier (13 dtex), which would normally give much better resilience and more firmness (support bulk) than products from lower denier fibers), one quarter of which was slickened with a commercial silicone slickener (20%), while the remaining three quarters (60%) was "dry", i.e. unslickened.

2. An 85/15 blend, compressed to about 25 $Kg/m^3$ (for comparison with Item B of the invention), of the same binder fiber (15%) of denier 4.4 dtex, but containing 85% of dry hollow commercial fiberfill of 6.1 dtex (significantly higher than the 4.7 dtex fiberfill used in Item B).

Despite the lower dtex in the cushions of the invention, Items A and especially B showed equal or better resilience (higher WR) and better support bulk (lower RS) than the comparisons 1 and 2 of similar density. Furthermore, the products of the invention have excellent durability,, whereas the comparisons are much inferior especially in this respect. For higher densities, similar comparison blends would fare even worse, so I tested the following representative products used in furnishing seat cushions or mattress cores; (the characteristics of polyurethanes can be varied by changing the ingredients to increase the softness or firmness, so these qualities are not controlled merely by the density):

3. Commercial polyurethane "soft" foam core at 35 Kg/m$^3$.

4. Commercial polyurethane "firm" foam core at 30 kg/m$^3$.

5. Commercial latex core (10 cm height) at 72 Kg/m$^3$.

The results in Table 1 indicate that products C and D of the invention are comparable in resilience to the foam cushions 3 and 4, which are firmer, and product E of the invention is somewhat more resilient than the latex. This is a significant achievement and could open the way for fiberfill to be used as the only filling material in certain end uses where previously foam cores have been used.

The durability of sample cushion E (at 50 Kg/m$^3$) is recorded as Example 1, in Table 2, and is compared with cushions of similar density made as described in Examples 2–10.

Example 2

The procedure of Example 1 was followed, except that the fiberballs were mixed with 10% of the same binder fiber before being molded at 50 Kg/m$^3$ to give a product of somewhat higher resilience and lower bulk losses, i.e. somewhat better durability.

Example 3

The procedure of Example 1 was followed, except that the fiberballs were treated with 0.35% of 3207A UCON and dried at 50° C. before being molded. This product shows lower initial resilience but less loss of bulk or resilience after the durability test.

Example 4

The procedure of Example 3 was followed, except that 0.35% of G-7264 was used instead of 3207A UCON. This product shows equal bulk and lower resilience than Example 1.

Example 5

The fiberballs of Example 4 were mixed with 10% of the same binder fiber in random form (not in balls) as in Example 2 before molding. This product shows the best combination of durability of resilience with good bulk.

Summarizing the durability results of Examples 1 to 5, Example 1 shows "dry" fiberballs molded alone, whereas Examples 3 and 4 show fiberballs slickened with non-silicone PEO-type slickeners molded alone, Example 2 shows dry fiberballs mixed with random binder fiber before molding, while Example 5 shows a combination of this feature and of the more effective slickener of Example 4. As shown in Table 2, the slickened items of Examples 3 and 4 performed remarkably well, showing that good bonding occurred, and held up well throughout the flexing treatment, despite the coating with these particular slickeners (whereas silicone-slickened fibers do not bond). Indeed their durability was better at equal support bulk than dry Example 1, but the resilience was lower. The best results were in Example 5, where the resilience was almost the same initially, but better after the durability test, and the support bulk showed better durability.

Examples 6–10

These Examples correspond to Examples 1–5, respectively, except that the tow of 4.7 dtex was mechanically crimped (to provide a mild mechanical crimp in addition to the spiral crimp) by passing through a stuffer box, under mild gate and roll pressures. The resulting fiberfill has Ω-crimp. The fiberballs of Examples 6–10 have 10–20% higher bulk than the fiberballs of Examples 1–5, whereas the molded products are not very different, but have lower resilience and lower bulk under high pressure (60N).

TABLE 1

| Sample | Density Kg/m$^3$ | IH2 cm | SB (7.5 N) cm | B (60 N) cm | AS cm | RS % | WR % |
|---|---|---|---|---|---|---|---|
| Invention | | | | | | | |
| A | 20 | 9.0 | 7.25 | 3.5 | 1.75 | 19 | 64 |
| B | 25 | 8.45 | 7.45 | 4.35 | 1.0 | 12 | 71.5 |
| C | 35 | 8.15 | 7.3 | 5.0 | 0.85 | 10 | 74.5 |
| D | 45 | 9.2 | 8.65 | 6.7 | 0.55 | 6 | 74 |
| E | 50 | 9.2 | 8.95 | 8.3 | 0.25 | 3 | 84 |
| Comparisons | | | | | | | |
| 1 | 20 | 14.8 | 11.2 | 4.4 | 3.6 | 24 | 63 |
| 2 | 25 | 12.4 | 9.45 | 3.6 | 2.95 | 24 | 63 |
| 3 | 35 | 9.7 | 9.6 | 7.2 | 0.1 | 1 | 75 |
| 4 | 30 | 9.6 | 9.5 | 8.0 | 0.1 | 1 | 76 |
| 5 | 72 | 10.5 | 10.1 | 8.0 | 0.4 | 4 | 81 |

TABLE 2

| | IH2 | | | SB 7.5 N | | | B 60 N | | | WP % | | |
|---|---|---|---|---|---|---|---|---|---|---|---|---|
| | BH | AF | Δ% | BF | AF | Δ % | BF | AF | Δ% | BF | AF | Δ% |
| Ex. 1 | 9.2 | 8.95 | 2.7 | 8.95 | 8.65 | 3.4 | 8.3 | 7.85 | 5.4 | 83.8 | 71.45 | 14.7 |
| Ex. 2 | 9.8 | 9.55 | 2.6 | 9.55 | 9.35 | 2.1 | 8.7 | 8.4 | 3.4 | 84.95 | 72.95 | 14.1 |
| Ex. 3 | 9.3 | 9.2 | 1.1 | 9 | 8.8 | 2.2 | 7.55 | 7.25 | 4.0 | 66.25 | 60.45 | 8.8 |
| Ex. 4 | 9.4 | 9.25 | 1.6 | 9.1 | 8.9 | 2.2 | 7.95 | 7.55 | 5.0 | 73.45 | 64.5 | 12.2 |
| Ex. 5 | 9.2 | 8.95 | 2.7 | 9 | 8.75 | 2.8 | 8.4 | 8.1 | 3.6 | 82.3 | 75.0 | 8.9 |
| Ex. 6 | 9.1 | 8.85 | 2.7 | 8.7 | 8.45 | 2.9 | 7.2 | 7.05 | 2.1 | 74.3 | 67.1 | 9.7 |
| Ex. 7 | 9.35 | 9.05 | 3.2 | 9.05 | 8.85 | 2.2 | 8.05 | 7.9 | 1.9 | 84.2 | 73.95 | 12.2 |
| Ex. 8 | 9.15 | 8.95 | 2.2 | 8.85 | 8.65 | 2.3 | 7.95 | 7.6 | 4.4 | 82.0 | 70.25 | 14.3 |
| Ex. 9 | 9.55 | 9.25 | 3.1 | 9 | 8.8 | 2.2 | 7.3 | 7.0 | 4.1 | 68.6 | 62.35 | 9.1 |
| Ex. 10 | 9.1 | 8.85 | 2.7 | 8.85 | 8.6 | 2.8 | 7.95 | 7.65 | 3.8 | 79.7 | 72.8 | 8.7 |

What is claimed is:

1. Fiberballs of average dimension about 2 to about 15 mm consisting essentially of randomly-arranged, entangled, spirally-crimped polyester fiberfill having a cut length of about 10 to about 100 mm, intimately blended with binder fibers in amount about 5 to about 50% by weight of the blend.

2. Fiberballs according to claim 1, wherein the binder fibers comprise sheath-core bicomponent fibers of cut length about 10 to about 100 mm, the sheath component of which is lower melting binder material, whereas the core component is polyester component of melting point higher than that of the binder material.

3. Fiberballs according to claim 2, wherein the binder material comprises about 5 to about 50% of the weight of the bicomponent fiber.

4. Fiberballs according to claim 2 or 3, wherein the binder fiber is spirally-crimped.

5. Fiberballs of average dimension about 2 to 15 mm, consisting of essentially of randomly-arranged, entangled, spirally-crimped bicomponent polyester/binder material fibers, having a cut length of about 10 to about 100 mm, wherein the bicomponent fibers are of sheath-core configuration, the sheath component being of lower melting binder material, whereas the core component is polyester component of melting point higher than that of the binder material.

6. Fiberballs according to claim 1, wherein the fiberfill has a coating cured thereto of a slickener consisting essentially of chains of poly(alkylene oxide).

7. Fiberballs according to claim 1, wherein the fiberfill is coated with a segmented copolymer of poly(ethylene terephthalate) and poly(ethylene oxide) in amount about 0.05 to about 1% of the weight of the fiberfill.

8. Fiberballs according to claim 1, wherein the fiberfill is coated with a modified poly(ethylene oxide)/-poly(propylene oxide) grafted with functional groups to permit crosslinking.

9. Process for making polyester fiberballs from a blend of spirally-crimped polyester fiberfill with binder fibers, wherein small tufts of the blend are repeatedly tumbled by air against the wall of a vessel to provide the fiberballs.

10. Process for making polyester fiberballs from spirally-crimped bicomponent polyester/binder material fibers, wherein the bicomponent fibers are of sheath-core configuration, the sheath component being of lower melting binder material, whereas the core component is polyester component of melting point higher than that of the binder material and wherein small tufts of the spirally-crimped fibers are repeatedly tumbled by air against the wall of a vessel to provide the fiberballs.

11. Process according to claim 9 or 10, wherein the tufts are tumbled against a cylindrical wall of a vessel by air stirred by blades attached to a shaft rotating axially in the vessel.

12. Process according to claim 11, wherein the small tufts and the air are recirculated through the vessel.

13. Process acording to claim 9 or 10, wherein the tufts are formed by feeding loose fibers into the vessel, and by rotating the shaft and blades at a speed such that the fiberfill is separated into the small tufts.

14. Process according to claim 9 or 10, wherein small tufts that are not elongated are formed before feeding them into the vessel for rounding and condensing by air-tumbling.

15. Process according to claim 9 or 10, wherein the fibers are treated with a slickener to reduce the hairiness of the resulting fiberballs.

16. Process for making a bonded product, wherein an assembly of fiberballs according to claim 1 are heat-bonded in an airstream and cooled.

17. Process for making a bonded product, wherein an assembly of fiberballs according to claim 6 are heat-bonded in an airstream and cooled.

18. Process for making a bonded product, wherein an assembly of fiberballs according to claim 7 are heat-bonded in an airstream and cooled.

19. Process for making a bonded product, wherein an assembly of fiberballs according to claim 8 are heat-bonded in an airstream and cooled.

20. Process according to any one of claims 16 to 19, wherein the fiberballs are first mixed with random binder fiber before forming an assembly and heat-bonding.

21. Process for making bonded fiberballs, wherein individual fiberballs according to claim 1 are individually heat-bonded in an airstream and cooled.

22. Process for making bonded fiberballs, wherein individual fiberballs according to claim 6 are individually heat-bonded in an airstream and cooled.

23. Process for making bonded fiberballs, wherein individual fiberballs according to claim 7 are individually heat-bonded in an airstream and cooled.

24. Process for making bonded fiberballs, wherein individual fiberballs according to claim 8 are individually heat-bonded in an airstream and cooled.

25. Process for making bonded fiberballs, wherein individual fiberballs according to claim 5 are individually heat-bonded in an airstream and cooled.

26. Process for making a loose bonded assembly, wherein bonded fiberballs are made according to any one of claims 21–25 and then assembled in a ticking.

* * * * *